United States Patent [19]

Hurst

[11] 4,007,766

[45] Feb. 15, 1977

[54] VAPOR VENT COLLECTION LINE FOR TANK CARS

[75] Inventor: Doug Hurst, Montreal West, Canada

[73] Assignee: General American Transportation Corporation, Chicago, Ill.

[22] Filed: Feb. 25, 1976

[21] Appl. No.: 661,098

[52] U.S. Cl. ..... 141/98; 141/198; 141/237; 141/303

[51] Int. Cl.[2] ..... B65B 3/04

[58] Field of Search ..... 141/1, 2, 18, 21, 35, 141/36, 59, 98, 99, 67, 100, 105, 231–233, 236, 237, 242, 243, 244, 346, 347, 374, 385–387, 113, 285, 325–327, 392, 198–225, 303, 94, 95; 105/358, 360; 61/10; 213/76; 222/145; 137/1, 571–575; 220/23.4

[56] References Cited

UNITED STATES PATENTS

| | | | |
|---|---|---|---|
| 3,675,670 | 7/1972 | Ogawa | 137/1 |
| 3,722,556 | 3/1973 | Jeffers et al. | 141/231 |
| 3,906,995 | 9/1975 | Schmidt | 141/35 |

FOREIGN PATENTS OR APPLICATIONS

| | | | |
|---|---|---|---|
| 1,407,176 | 6/1965 | France | 141/35 |

*Primary Examiner*—Houston S. Bell, Jr.
*Attorney, Agent, or Firm*—Prangley, Dithmar, Vogel, Sandler & Stotland

[57] ABSTRACT

A railway tank car is provided for interconnection in fluid communication with associated tank cars. Each of the tank cars includes a tank mounted on a chassis structure with two lading conduits respectively coupled to the tank, each having an outer end extending outwardly from the tank adjacent to the top thereof and at least one having an inner end extending into the tank and terminating near the bottom thereof. A vapor vent is connected to the tank to vent gas vapors produced during loading. The vent is closed by a valve actuated by a control mechanism in response to a level sensing means which determines the level of liquid lading in the tank. The tank car or train may be loaded or unloaded from either end thereof since the cars can have symmetrical internal piping, and, similarly the gas vapor may be collected from either end of the tank car or train.

8 Claims, 2 Drawing Figures

VAPOR VENT COLLECTION LINE FOR TANK CARS

CROSS REFERENCE TO RELATED APPLICATION

This application is an improvement of Application, Ser. No. 403,828, filed Oct. 5, 1973, for MANIFOLDED TANK CARS FOR UNIT TRAIN SERVICE, now U.S. Pat. No. 3,897,807, issued Aug. 5, 1975.

BACKGROUND OF THE INVENTION

The present invention relates to railway tank cars, and in particular, to manifolded tank cars which may be interconnected to accommodate loading or unloading of the entire group of interconnected cars without movement thereof from a single point therealong, thereby accommodating consecutive loading, transporting and unloading of fluid ladings and facilitating the formation of unit trains.

The concept of providing fluid communication among a series of interconnected railway tank cars is disclosed in the prior art, but previous systems have failed to provide an inner tank connection arrangement which insured safe handling of the fluid ladings during transportation, and which also was convenient for loading and unloading of the fluid ladings from either end of the train.

For example, U.S. Pat. No. 1,542,116, issued to R. Welcker, discloses railway tank cars for interconnection in a manifolded arrangement from a single location, without moving or disconnecting the cars. However, Welcker's arrangement does not provide for continuous loading of the interconnected tanks from a single location, much less providing for continuous loading or unloading from either end of the tank car train. Furthermore, the inner tank lading connections disclosed by the Welcker patent are along the longitudinal axis of the tanks which is found to be a disadvantageous arrangement. In addition, the exposed valves in the Welcker patent must be individually and manually operated and are also a potential dangerous hazard.

United States Pat. No. 3,722,556, issued to William Jeffers et al, discloses a manifolded tank car arrangement which accommodates both loading and unloading of a string of interconnected tank cars from a single point, but Jeffers et al. provide the inner tank lading connections at the bottoms of the tank and also, in addition, they provide exposed and unprotected lading flow control valves. Furthermore, Jeffers et al. do not provide a symmetrical tank car which may be loaded or unloaded from either end thereof and which during loading automatically determines the final outage of the lading in the tank, a feature which is critically necessary with certain bulk lading commodities to accommodate product expansion in transit.

SUMMARY OF THE INVENTION

The present invention provides a railway tank car for unit train service which determines the outage independently of the inlet and outlet conduits and which may permit the train or the individual tank car to be loaded or unloaded from either end thereof and enable the vapor collected from the individual tank cars to be collected and stored at either end of the train, thereby allowing the vapor collection point to be substantially adjacent to the commodity pump and piping.

It is an important object of the present invention to provide a tank car of the character described in which the outage is determined independently of the lading conduits.

Another important object of the present invention is to provide a tank car wherein the vapor collection means can be adjacent the lading storage.

Another object of the present invention is to provide a railway tank car for interconnection in fluid communication with associated tank cars by flexible connecting conduits for accommodating consecutive loadings, unloading, and transportation of expandable ladings, said tank car comprising a wheeled chassis structure provided with chassis coupling means for coupling to the chassis of associated cars, a tank mounted on said chassis structure, two lading conduits respectively coupled to said tank in fluid communication therewith, each of said lading conduits having an outer end extending outwardly from said tank adjacent to the top thereof and an inner end extending into said tank and terminating near the bottom thereof, a gas vapor vent coupled to said tank in fluid communication therewith for venting gas vapor from said tank, valve means positioned in said gas vapor vent for sealing said vent to trap gas vapor in said tank, means for sensing the level of liquid lading in said tank during the filling thereof through one of said lading conduits, and control means responsive to said level sensing means for operating said valve means to close said valve means when the liquid lading reaches a predetermined level, continued filling of said tank through said one lading conduit after the closing of said valve means causing compression of gas vapor trapped above said liquid lading to a pressure at which occurs outflow of the liquid lading through the other of said lading conduits at a rate equal to the rate of inflow of liquid lading through said one lading conduit, whereby said tank may be loaded and unloaded through either lading conduit.

Another object of the present invention is to provide a tank car of the type set forth in which a vapor collecting mechanism is connected to the vent to collect vapor leaving the tank car.

These and other objects of the present invention together with further objects and advantages thereof will best be understood by reference to the following specification taken in connection with the accompanying drawings:

DESCRIPTION OF THE PREFERRED EMBODIMENT

Figure 1:
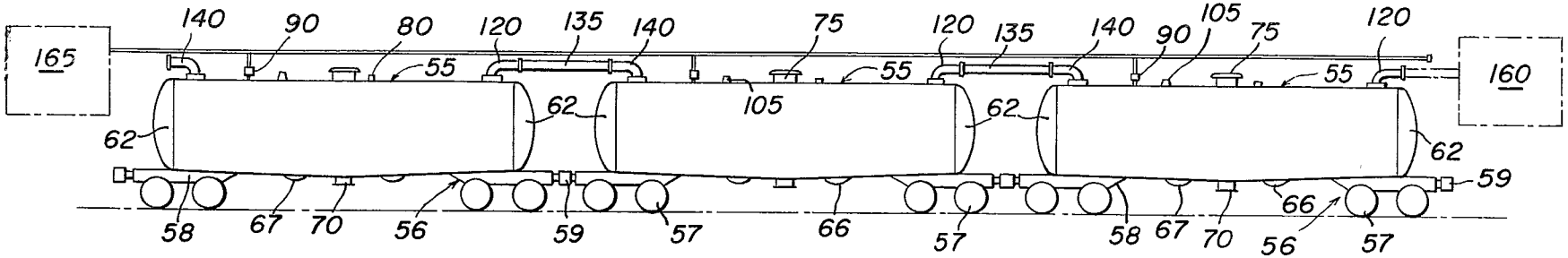
FIG. 1 is an elevational view of a railway train showing the individual tanks in fluid communication one with the other.

Referring now to the drawings, there is disclosed a train 50 which includes a plurality of interconnected tank cars 55, each of which includes a pair of trucks 56 having railway wheels 57 rotatably mounted thereon. A bolster 58 is included and has a coupling mechanism 59 on the end thereof which is adapted to couple adjacent tank cars 55 one to the other. The tank car 55 includes a cylindrical shell 61 closed at either end thereof by dome ends 62. The cylindrical shell 61 has a bottom 63 which slopes downwardly from either dome end 62 toward the center. Accordingly, it is seen that the cylindrical shell 61 in combination with the dome ends 62 provide a fluid-tight body to accommodate the liquid lading 65 therein.

The bottom 63 of the cylindrical shell 61 is provided with spaced-apart sumps 66 and 67 which are positioned on opposite sides of an outlet mechanism 70 located in substantially the center of the bottom 63, the outlet mechanism 70 being provided with a cap 71. A manway 75 is mounted in the top of the cylindrical shell 61 and is provided with a manway cover 76. Finally, a safety valve 80 is provided at the top of the cylindrical shell 61 intermediate the manway 75 and one of the dome ends 62, the safety valve 80 being standard in the art.

A vapor control mechanism 90 at the top of the tank car 55 includes a valve 91 in fluid communication with the inside of the tank through a gas vapor vent tube 92 extending downwardly and into the tank 55, the tube 92 having an inner end 93 positioned a predetermined distance below the top of the tank. A pipe section 96 of the gas vapor vent tube extends upwardly from the valve 91 and joins an elongated manifold 100 which extends the longitudinal length of the tank car 55 and is vertically spaced upwardly therefrom. Inside the tank car 55 there is provided a seal float 97 vertically aligned with the inner end 93 of the gas vapor vent tube 92, the seal float 97 being connected to a lever 98 pivotally mounted as at 99 to the top of the tank car 55.

The manifold pipe 100 includes fittings 101 at either end thereof which are positioned inboard of the associated end dome 62. A flexible conduit 102 interconnects adjacent fittings 101 of adjacent tank cars 55.

A level gauge 105 is mounted intermediate the vapor control mechanism 90 and the manway 75. The level gauge 105 includes a tube 106 extending downwardly into the tank car 55 which is mounted thereto by means of a plurality of struts 107. A metallic spindle 108 extends downwardly into the tube and moves with a pair of magnetic floats 109 on the outside of the tube 106. A magnet 110 is mounted on the bottom of the spindle 108 and moves with the magnetic floats 109 when the level of the liquid lading 65 reaches the bottom of the tube 106, thereby to move the spindle 108 upwardly and downwardly within the tube 106 according to the level of the liquid lading 65 in the tank car 55. Means, not shown, prevent the floats 109 from dropping away from the end of the tube 106, such that when the level of the lading 65 drops below the tube 106, the floats 109 remain with the tube and do not follow the lading down to the bottom of the tank 55. The gauge 105 is but representative of any level gauge for sensing the level of liquid in the vessel.

A control mechanism 115 includes a sensor 116 for determining the vertical position of the spindle 108 and a valve actuator 117 for actuating the valve 91 of the vapor control mechanism 90 in response to the position of the spindle 108 of the level gauge 105, to interrupt fluid communication between the vapor vent tube 96 and the tank 55. When the lading level 65 drops below a predetermined level, the control mechanism 115 causes the valve 91 to be opened, thereby establishing fluid communication between the tank 55 and the vapor vent tube 96. The actuator 117 may be pneumatically operated, or any art recognized equivalent. Accordingly, it is seen that there is provided a control mechanism 115 responsive to the position of the level gauge 105, and hence the level of the liquid lading 65 in the tank 55, for actuating the valve 91 of the vapor control mechanism 90, thereby to open or close the valve 91 which in turn establishes or interrupts fluid communication between the manifold 100 and the tank car 55. The valve 91 may also be pneumatically locked closed during transport of the tank car 55, and hence an entire train, for safety and also to ensure that the valves remain closed during unloading.

The tank car 55 is provided with a lading conduit 120 at one end thereof which includes an elbow 121 connected to a valve housing 122 in registry with an opening in the top of the cylindrical shell 61. A flange 123 is positioned immediately below the opening in the shell 61 and in sealing relationship thereto. A sinuous pipe 124 depends from the sealing flange 123 diagonally downwardly through the tank 55, the inner end 125 of the pipe 124 terminating near the bottom 63 of the tank 55 and in particular in registry with the sump 66. More particularly, the terminal end 125 of the pipe 124 has the axis thereof normal to the longitudinal axis of the tank car 55. Extending outwardly from the elbow 121 is a horizontal pipe section 127 which is provided with a mounting flange 128 at the end thereof, the mounting flange 128 being positioned in registry with the fitting 101 on the manifold 100 and inboard of the associated dome end 62. A flexible conduit 135 is mounted to the lading conduit 120 by means of a mounting flange 136 which is connected to the flange 128, thereby to interconnect adjacent tank cars 55 with flexible conduits 135. Because the mounting flanges 128 are inboard of the associated dome ends 62 the flexible conduits 135 have sufficient length to accommodate the normal swaying motions of the individual tank cars 55 during movement thereof with a unit train 50.

The tank car 55 also includes a lading conduit 140 identical in construction with the lading conduit 120. The lading conduit 140 has an elbow 141 connected to a valve housing 142 in registry with an opening in the top of the cylindrical shell 61. A sealing flange 143 is mounted immediately below the opening in the cylindrical shell 61 and in sealing relationship thereto. A sinuous pipe 144 extends diagonally downwardly from the flange 143 and terminates in an inner end 145 near the bottom 63 of the tank 55 in registry with the sump 67. More particularly, the inner end 145 of the pipe 144 has the axis thereof normal to the longitudinal axis of the tank 55, thereby to provide symmetrical inner piping 124 and 144 for the tank car 55. The conduit 140 further includes a horizontal pipe section 147 extending outwardly from the elbow 141 and terminating in a mounting flange 148, the mounting flange 148 being located in registry with the adjacent fitting 101 of the manifold 100 and inboard of the associated dome end 62. The mounting flange 148 accommodates the mounting flange 136 of the associated flexible conduit 135 which interconnects the tank car 55 with the adjacent tank car.

Each of the valve housings 122 and 142 accommodate a butterfly valve (not shown) which operates in the usual manner between an open position thereof in which communication is provided between the inside of the tank car 55 and the flexible conduit 135 which is connected to an adjacent tank car 55 and a closed position in which communication between adjacent tank cars is interrupted. A principal feature of the present invention is that the tank car 55 may be loaded from either end thereof and also unloaded from either end thereof, however, the operation of the tank car will be explained with the loading occurring through the lading conduit 120 since the conduits 120 and 140 are identical, as is the loading operation.

Figure 2:
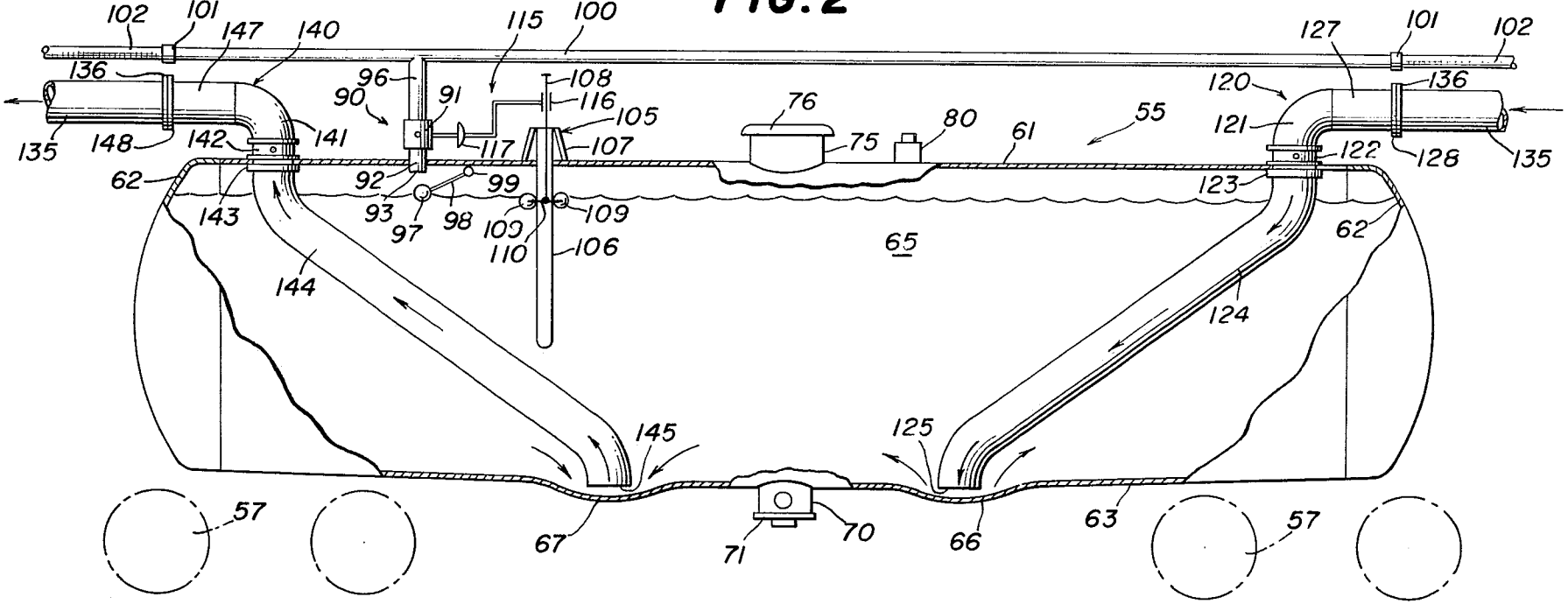
FIG. 2 is an enlarged view partly in elevation showing the lading conduits and the vapor collection system for the individual tank car.

In FIG. 1, a source of lading 160 is connected to the conduit 120 in the right handmost tank car 55. The valves in the individual valve housings 122 and 142 in each of the cars 55 comprising the train 50 are open, thereby to establish fluid communication between adjacent tank cars in the train. As liquid lading 65 from the source 160 thereof flows through the flexible conduit 135 and into the conduit 120 it follows the direction shown by the arrows in FIG. 2. The liquid lading flows out of the end 125 and into the tank car 55. Gas vapor from the liquid lading 65 in the tank car 55 begins to accumulate between the level of the liquid lading and the top of the cylindrical shell 61. The gas vapor is continuously vented to enable the lading 65 to reach the desired level, and, therefore, the valve 91 is open allowing gas vapor to exit from the tank car 55 through the gas vapor vent tube 92, the valve 91, the pipe section 96 of the tube 92 and the manifold 100.

The manifold 100 is connected to a vapor treatment system 165 which may be located at either end of the train 50. In the drawings, the vapor treatment system 165 is located at the end of the train opposite to the source of liquid lading 160, however, it is apparent that the vapor treatment system may be located adjacent to the source of liquid lading, if desired.

When the liquid lading 65 reaches a predetermined level, the control mechanism 115 senses the level of the liquid lading 65 in the tank car by means of the vertical position of the spindle 108 of the level gauge 105. Since the spindle 108 of the level gauge 105 rises as the magnetic floats 109 rise with the level of liquid lading 65, the control mechanism 115 actuates the valve 91 when the liquid level 65 reaches a predetermined level. In this manner, the "outage" or level of lading 65 in the tank car 55 may be predetermined for each individual car. Clearly, by setting the control mechanism 115, the "outage" for each tank car 55 in the train 50 may be identical or different as desired.

If, for any reason, the control mechanism 115 becomes inoperative and does not close the valve 91, then the float valve 97 will close the end 93 of the gas vapor vent tube 92 when the liquid nears the top of the cylindrical shell 61, thereby to prevent overfilling the tank car 55. Since the float 97 is pivoted at the top of the cylindrical shell 61, it is apparent that the float 97 will seal the tube end 93 before the liquid level of the lading 65 in the tank 55 reaches the top of the tank 55. The level at which the float 97 seals the tube end 93 is determined by the distance inside the tank 55 that the gas vapor tube 92 extends and the diameter of the float 97.

In any event, once either the valve 91 is closed or the float 97 seals the tube end 93, vapor will build up in the tank car 55 until the pressure in the car is sufficient to force lading 65 upwardly through the conduit 140 and into the next adjacent tank car 55, the lading flow path being upwardly through the conduit 144 in the direction of the arrows, and outwardly through the elbow 141, the conduit 147 and the flexible conduit 135 into the next adjacent tank car 55. This operation is continued until all of the tank cars 55 in the train 50 are filled seriatim.

In order to unload the tank train 50, one of the end tank cars 55 is connected to a source of gas pressure. The gas used may be either air or any other gas such as nitrogen. By way of example, the individual tank car 55 will be described with the incoming gas being connected to the conduit 140 and the unloading of the liquid lading being accomplished through the conduit 120. Gas under pressure from a source thereof is connected to the conduit 140 and as gas is introduced into the tank car 55 through the conduit 144, pressure builds up inside the tank car. Since the valve 91 has previously been closed either by the control mechanism 115 or the pneumatic feature previously discussed, as well as the safety valve 80, the liquid lading 65 in the tank car is forced upwardly through the conduit 124, the elbow 121 and through the flexible conduit 135 into the next adjacent car. In this manner, the entire tank train 50 may be unloaded from a single point source of pressurized gas. It is understood that before unloading all valves 91 and 80 in all of the tank cars 55 are closed to allow the requisite pressure build up.

The individual tank cars are unloaded seriatim until the entire train 50 is emptied. Due to the sloping of the bottom 63 of the tank car 55, as well as the sumps 66 and 67, little liquid lading 65 is left in the tank cars after the emptying thereof in the aforementioned manner. During both the loading and the unloading operations, the butterfly valves in the housings 122 and 142 of each of the tank cars 55 are opened, thereby to put adjacent cars into fluid communication one with the other. However, during the transportation of the train 55 to its destination, the individual butterfly valves in the housings 122 and 142 of each tank car 55 are closed, thereby to insulate the lading 65 in the tank cars from the outside environment.

If it is desired, unloading of the liquid lading may be accomplished through the outlet mechanism 70 at the bottom of the tank car 55, however, this forms no part of the present invention which pertains to the individual outage determination for each tank car 55 in a train 50 and to the symmetrical nature of the internal piping in each of the cars which permits loading and unloading of each of the cars 55 from either end thereof with equal facility. The specific combination of the vapor control mechanism 90, with the manifold 100, the level gauge 105 and the control mechanism 115, permits the outage or the level of the liquid lading 65 in each of the tank cars 55 to be predetermined individually, and not necessarily uniformly, prior to the loading of the entire train 50. In addition, the particular combination of parts and configuration described in the present invention allows the gas vapors from each of the tank cars 55 to be collected at either end of the tank train 50, to accommodate gas treatment centers which are located with the source of the liquid lading. This is particularly advantageous where the collected gas vapors are condensed and re-introduced to the source of liquid lading. Accordingly, the present invention provides additional flexibility nowhere shown or suggested by any of the prior art systems.

While there has been described what is at present considered to be the preferred embodiment of the present invention, it will be understood that various modifications and alterations may be made herein without departing from the true spirit and scope of the present invention, and it is intended to cover in the appended claims all such modifications and alterations as fall within the true spirit and scope of the present invention.

What is claimed is:

1. A railway tank car for interconnection in fluid communication with associated tank cars by flexible connecting conduits for accommodating consecutive loadings, unloading, and transportation of expandable ladings, said tank car comprising a wheeled chassis structure provided with chassis coupling means for coupling to the chassis of associated cars, a tank mounted on said chassis structure, two lading conduits respectively coupled to said tank in fluid communication therewith, each of said lading conduits having an outer end extending outwardly from said tank adjacent to the top thereof and an inner end extending into said tank and terminating near the bottom thereof, a gas vapor vent coupled to said tank in fluid communication therewith for venting gas vapor from said tank, valve means positioned in said gas vapor vent for sealing said vent to trap gas vapor in said tank, means for sensing the level of liquid lading in said tank during the filling thereof through one of said lading conduits, and control means responsive to said level sensing means for operating said valve means to close said valve means when the liquid lading reaches a predetermined level, continued filling of said tank through said one lading conduit after the closing of said valve means causing compression of gas vapor trapped above said liquid lading to a pressure at which occurs outflow of the liquid lading through the other of said lading conduits at a rate equal to the rate of inflow of liquid lading through said one lading conduit, whereby said tank may be loaded and unloaded through either lading conduit.

2. The railway tank car set forth in claim 1, and further comprising spaced-apart sumps in the bottom of said tank car, the inner ends of each of said lading conduits being positioned in registry with an associated one of said sumps.

3. The railway tank car set forth in claim 1, and further comprising means mounted inside of said tank for interrupting fluid communication between said gas vapor vent and the gas vapor in said tank car before the liquid lading entirely fills said tank car, thereby to prevent overfilling of said tank car.

4. The railway tank car set forth in claim 1, wherein said level sensing means includes a magnetic float for moving a vertically extending metallic spindle to indicate the level of the liquid lading in said tank car.

5. A railway tank car for interconnection in fluid communication with associated tank cars by flexible connecting conduits for accommodating consecutive loadings, unloading, and transportation of expandable ladings, said tank car comprising a wheeled chassis structure provided with chassis coupling means for coupling to the chassis of associated cars, a tank mounted on said chassis structure, two lading conduits respectively coupled to said tank in fluid communication therewith, each of said lading conduits having an outer end extending outwardly from said tank adjacent to the top thereof and an inner end extending into said tank and terminating near the bottom thereof, a gas vapor vent coupled to said tank in fluid communication therewith for venting gas vapor from said tank, valve means in said gas vapor vent for sealing said vent to trap gas vapor in said tank, collecting means in fluid communication with said gas vapor vent for collecting gas vapors vented from said tank, means for sensing the level of liquid lading in said tank during the filling thereof through the other of said lading conduits, and control means responsive to said level sensing means for operating said valve means to close said valve means when the liquid lading reaches a predetermined level, continued filling of said tank through one of said lading conduits after the closing of said valve means causing compression of gas vapor trapped above said liquid lading to a pressure at which occurs outflow of the liquid lading through the other one of said lading conduits at a rate equal to the rate of inflow of liquid lading through said one lading conduit.

6. The railway tank car set forth in claim 5, wherein said collecting means is a manifold extending the length of the tank car.

7. The railway tank car set forth in claim 5, and further comprising a manifold in fluid communication with each gas vapor vent and extending the length of each tank, and manifold coupling means on each end of each manifold for coupling to an associated end of an associated flexible connecting conduit to place each manifold in fluid communication with the manifold of adjacent-like tank cars.

8. A railway tank car train for accommodating consecutive loading, unloading and transportation of expandable ladings, said train comprising a plurality of railway tank cars connected in tandem relationship, each of said tank cars including a wheeled chassis structure provided with chassis coupling means for coupling to the chassis of the associated cars, a tank mounted on said chassis structure, two lading conduits respectively coupled to said tank in fluid communication therewith, each of said lading conduits having an outer end extending outwardly from said tank adjacent to the top thereof and an inner end extending into said tank and terminating near the bottom thereof, a gas vapor vent coupled to said tank in fluid communication therewith for venting gas vapor from said tank, valve means in said gas vapor vent for sealing said vent to trap gas vapor in said tank, means for sensing the level of liquid lading in said tank during the filling thereof through the other of said lading conduits, control means responsive to said level sensing means for operating said valve means to close said valve means when the liquid lading reaches a predetermined level, and conduit coupling means on each of said lading conduits for coupling to an associated end of an associated flexible connecting conduit to place said tank in fluid communication with the tank of adjacent-like tank cars, continued filling of said tank through one of said lading conduits after the closing of said valve means causing compression of gas vapor trapped above said liquid lading to a pressure at which occurs outflow of the liquid lading through the other lading conduit at a rate equal to the rate of inflow of liquid lading through said one lading conduit.

* * * * *